US005287997A

United States Patent [19]

Rodrigue et al.

[11] Patent Number: 5,287,997

[45] Date of Patent: Feb. 22, 1994

[54] CARTON FILLING SYSTEM

[75] Inventors: John Rodrigue, St. Paul; Susan G. Perreault, Hugo, both of Minn.

[73] Assignee: Tetra Laval Holdings & Finance SA, Pully, Switzerland

[21] Appl. No.: 959,802

[22] Filed: Oct. 13, 1992

[51] Int. Cl.[5] ..... G01F 11/08

[52] U.S. Cl. ..... 222/380; 222/309; 222/509; 251/63.6; 251/318; 384/49

[58] Field of Search ..... 251/63.6, 318; 384/14, 384/49; 222/287, 309, 380, 509, 559, 501

[56] References Cited

U.S. PATENT DOCUMENTS

| | | | |
|---|---|---|---|
| 1,509,535 | 9/1924 | Wertz | 222/509 X |
| 1,867,601 | 7/1933 | Stokes | 222/380 X |
| 2,620,113 | 12/1952 | Bodendoerfer et al. | 222/442 X |
| 3,201,002 | 8/1965 | Williams | 222/309 |
| 3,285,300 | 11/1966 | Mistarz | 222/564 X |
| 3,517,688 | 6/1970 | Scholle | 251/63.6 X |
| 4,234,107 | 11/1980 | Gernlein | 222/380 X |
| 4,715,791 | 12/1987 | Berlin et al. | 417/274 |
| 4,759,695 | 7/1988 | Bordini | 222/148 X |
| 4,776,367 | 10/1988 | Hilmersson et al. | 137/501 |
| 4,869,397 | 9/1989 | Corniea et al. | 222/309 X |
| 4,903,740 | 2/1990 | Corniea et al. | 222/449 X |
| 5,025,991 | 6/1991 | Stainbrook et al. | 239/459 |

FOREIGN PATENT DOCUMENTS

| | | | |
|---|---|---|---|
| 0222609 | 5/1987 | European Pat. Off. | 222/380 |
| 0465687 | 1/1992 | European Pat. Off. | 222/380 |
| 0480346 | 4/1992 | European Pat. Off. | 251/318 |
| 2645053 | 4/1977 | Fed. Rep. of Germany | 251/318 |

*Primary Examiner*—Andres Kashnikow
*Assistant Examiner*—Kenneth Bomberg
*Attorney, Agent, or Firm*—& Mathis Burns, Doane, Swecker

[57] ABSTRACT

A system for dispensing liquid food products is disclosed. The product is drawn from a source to a metering chamber through a supply valve, and then conducted to a dispensing valve to fill performed containers. The valves have a valve stem that reciprocates to open and close the valve. The valve stem is supported in the passage through which the product flows by bearings. The bearings have balls that engage the stem and the wall of the passage. The use of balls to support the stem facilitates cleaning of the passage after use, and yet provides good support for the valve stem.

10 Claims, 4 Drawing Sheets

CARTON FILLING SYSTEM

FIELD OF THE INVENTION

This invention relates to methods and apparatus for filling performed cartons with liquid contents, and more particularly to methods and apparatus for controlling the flow of liquid for filling cartons and for cleaning the apparatus following use.

BACKGROUND OF THE INVENTION

Various systems have been proposed and used for filling cartons with liquids, such as milk and juice. Typically, the cartons are preformed and sealed at the bottom. The cartons are placed on a conveyor which advances periodically in a series of equal steps. The cartons first pass through a sterilization station where the interior of the cartons is sterilized. The cartons then pass to a fill station where the liquid contents are transferred from a supply tank to fill the carton. The carton then passes to a closing station where the top of the carton is folded together, and finally the carton passes to a sealing station where the thermoplastic-coated carton is heat-sealed at the top.

The liquid fill system of conventional machines provides for dispensing a measured quantity of liquid in each carton by means of various valve arrangements. Periodically, the pipes and valves must be cleaned and sterilized. Typically, this involves conducting a sterilization fluid through the fill system where it comes in contact with the valves and seals to remove any residual milk or juice and to kill any bacteria that might be present in the system.

While prior fill systems have been capable of filling cartons, there is a need for improving the efficiency of the filling system and for improving the arrangement for cleaning the filling system.

SUMMARY OF THE INVENTION

It is an object of this invention to provide a valve arrangement which provides effective control over the filling operation and which is capable of being readily cleaned with sterilization solution.

In accordance with this invention, the product, which may be milk or juice, is supplied to a metering chamber through a control valve which opens and closes by means of a pneumatic cylinder. From the inlet valve, the liquid flows to a metering chamber where the quantity of liquid for filling a carton is temporarily stored. A discharge valve is mounted below the metering chamber. The discharge valve opens and closes in response to an electro-pneumatic actuator. The components of the fill system are arranged to provide adequate slope for drainage during the cleaning operation. The valve stems for the inlet valve and the discharge valve have linear ball bearings which avoid obstruction of the liquid through the valve passages and provide minimal obstruction to the cleaning fluid during the cleaning operation.

DESCRIPTION OF THE DRAWINGS

A preferred embodiment of the invention is illustrated in the accompanying drawings, in which.

DETAILED DESCRIPTION

Figure 1:
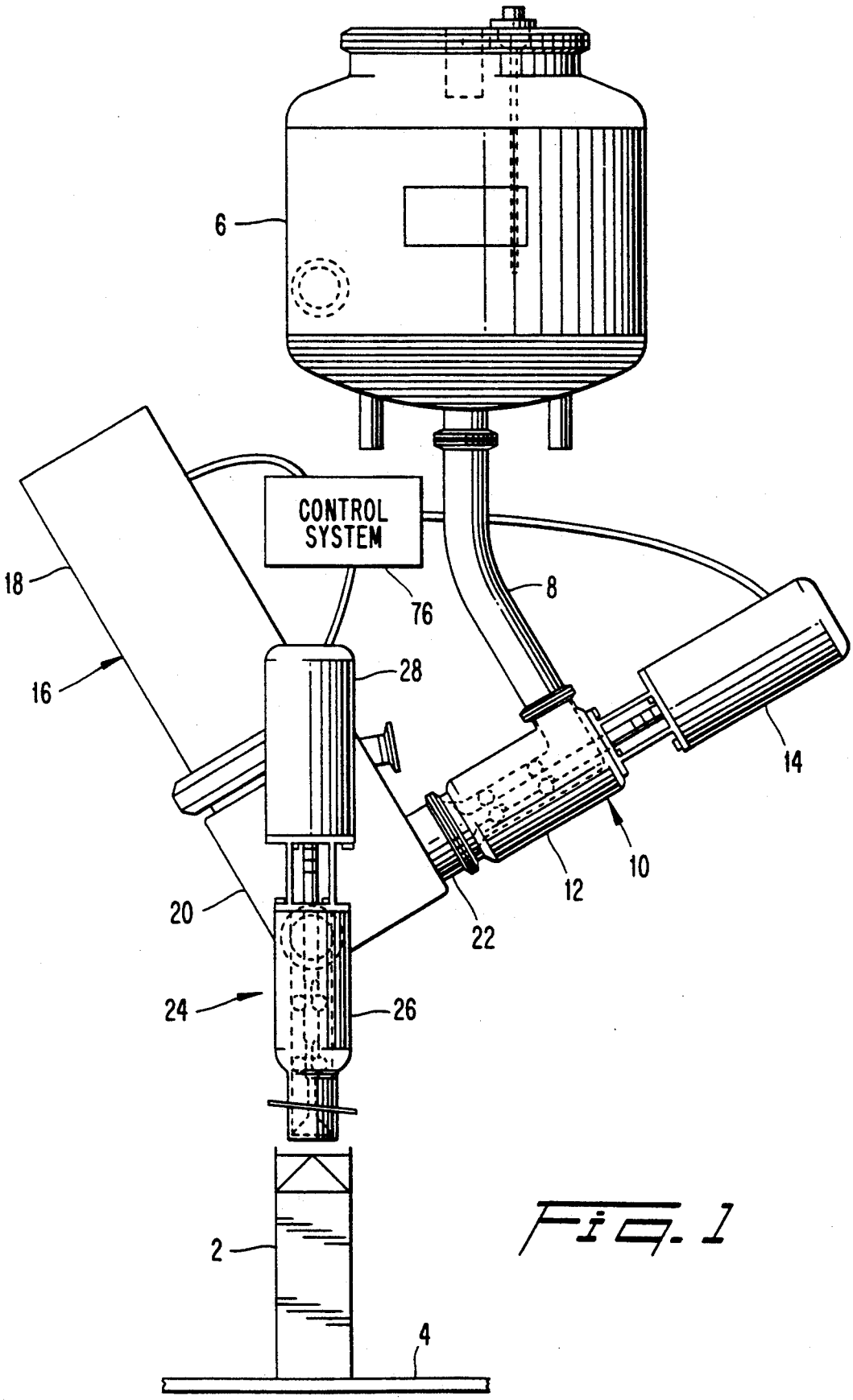
FIG. 1 is an elevational view, partially schematic, of the filling arrangement in accordance with this invention.

In a conventional filling machine, preformed cartons 2 are closed at the bottom and positioned on a conveyor 4 which advances intermittently toward the right as viewed in FIG. 1. The carton 2 has an open top through which liquid contents are 10 supplied to fill the carton. Subsequently, the carton 2 will be closed at the top and heat-sealed.

The fill apparatus in accordance with this invention includes a product tank 6 which contains the liquid that is to be filled into the carton 2. The product tank 6 has a suitable control system for maintaining a predetermined level of liquid in the tank. A pipe 8 connects the tank 6 with a supply valve assembly 10 which includes a control valve 12 and a pneumatic cylinder 14. The control valve 12 supplies liquid to a dispensing pump which includes an electrical actuator 18 and a pump chamber body 20. A pipe section 22 connects the control valve 12 with the chamber body 20. The chamber body 20 is also connected with a dispensing valve assembly 24 which includes a dispensing valve 26 and an electro-pneumatic actuator 28. The actuator 28 includes a solenoid 30 which controls a poppet valve 32. Air is supplied to opposite sides of a floating piston 34 through air supply hoses 36 and 38. An air passage 40 connects the lower side of the piston 34 with the poppet valve 32. When the poppet valve 32 is open, air from the lower side of the piston 34 bleeds through the passage 40 and through the valve 32, thereby reducing the pressure on the lower side of the piston so that the pressure on the upper side of the piston drives the piston downwardly as viewed in FIG. 2. A valve stem 42 is attached at its upper end to the piston 34 so that downward movement of the piston 34 causes the valve stem 42 to move downwardly. A coil spring 44 urges the piston 34 upwardly as viewed in FIG. 2 in the event of loss of air pressure. The valve stem 42 extends into the valve element 26 in order to operate the dispensing valve at the lower end of the valve stem.

Figure 2:
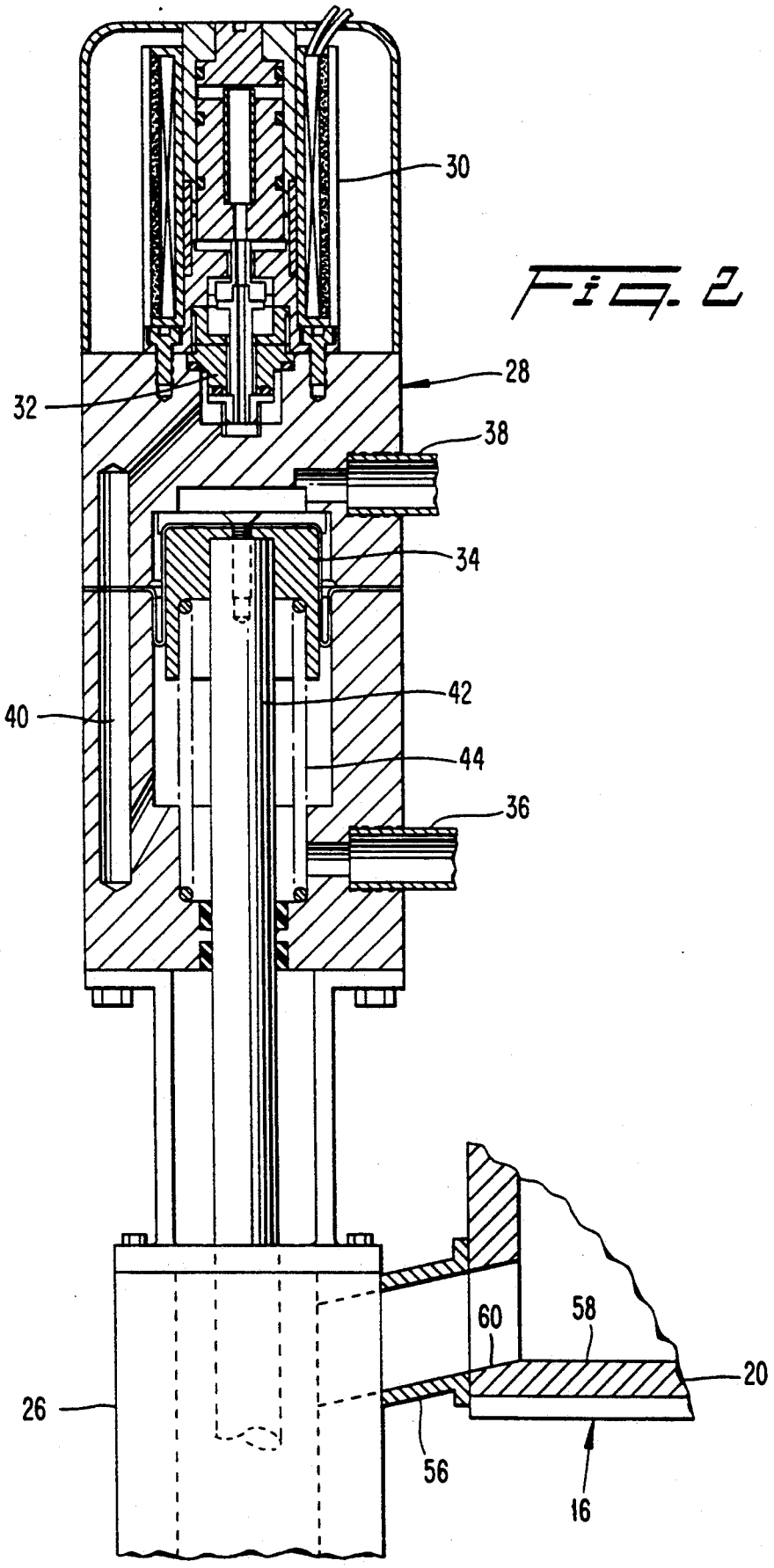
FIG. 2 is a cross-sectional view of the dispensing valve actuator.
Figure 4:
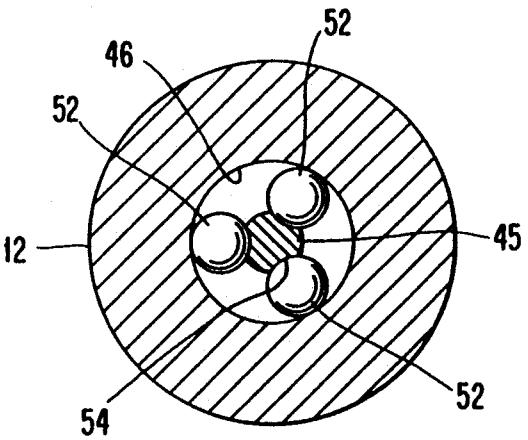
FIG. 4 is a cross-sectional view of the supply valve along the line 4—4 in FIG. 3.
Figure 3:
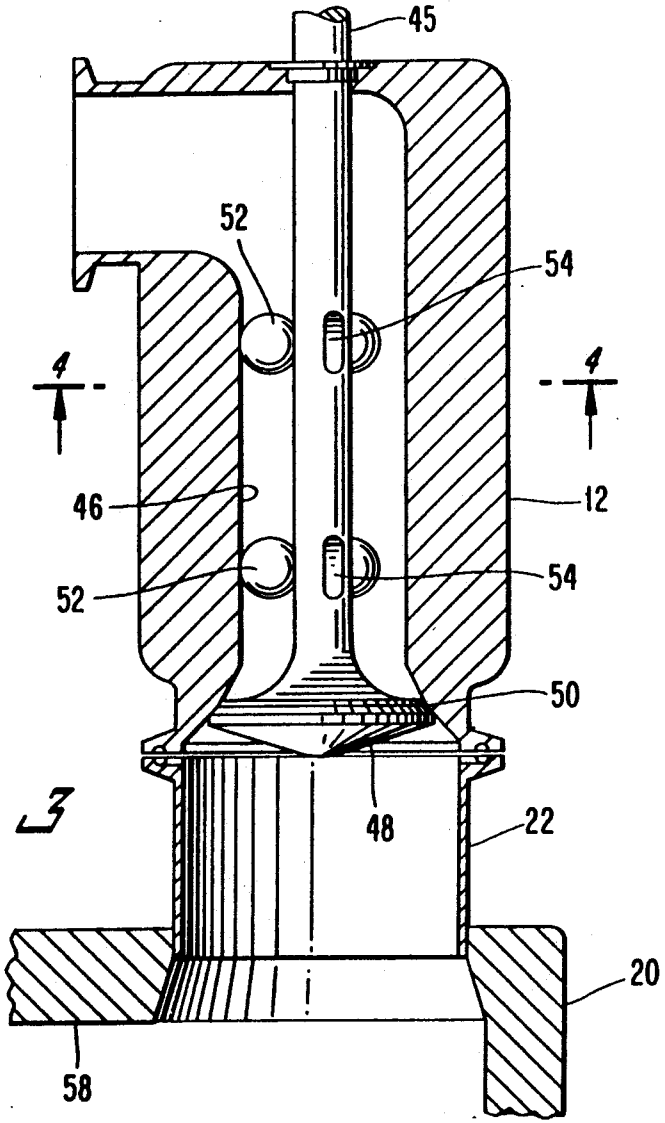
FIG. 3 is a cross-sectional view of the supply valve.

The supply valve 12 is shown in FIG. 3 in cross-section. The valve 12 has a valve stem 45, which extends through a central bore 46 in the body of the valve 12. A valve element 48 is provided at the lower end of the valve stem 45 and a valve seat 50 is provided in the bore 46 to form a seal with the valve element 48. The valve stem 45 is caused to reciprocate in the valve body 12 by the pneumatic actuator 14. The valve stem is guided in the bore 46 by a pair of ball guides formed by three ball bearings 52, each of which is received in a longitudinal groove 54 formed in the valve stem 45. For illustration purposes, the ball bearing that cooperates with one of the grooves 54 in FIG. 3 has been omitted. For both bearings, it is necessary to have at least three balls to center the valve stem 45. The grooves 54 are elongated to allow longitudinal movement of the valve stem while the balls 54 rotate relative to the surface of the bore 46 during up and down motion of the valve stem 45. The same bearing arrangement is provided for the discharge valve 26, as shown in FIG. 1. The valve element for dispensing the liquid into the cartons may be of any suitable type. For example, the valve elements described in U.S. Pat. Nos. 5,025,991, 4,903,740, or 4,869,397 may be used. Liquid product is supplied to the dispensing valve 26 through a connector 56 from the dispensing pump 16. The chamber body 20 has a piston chamber 58 with a port 60 through which liquid product is discharged from the chamber 58 into the central bore of the dispensing valve 26, as shown in FIG. 2.

Figure 5:
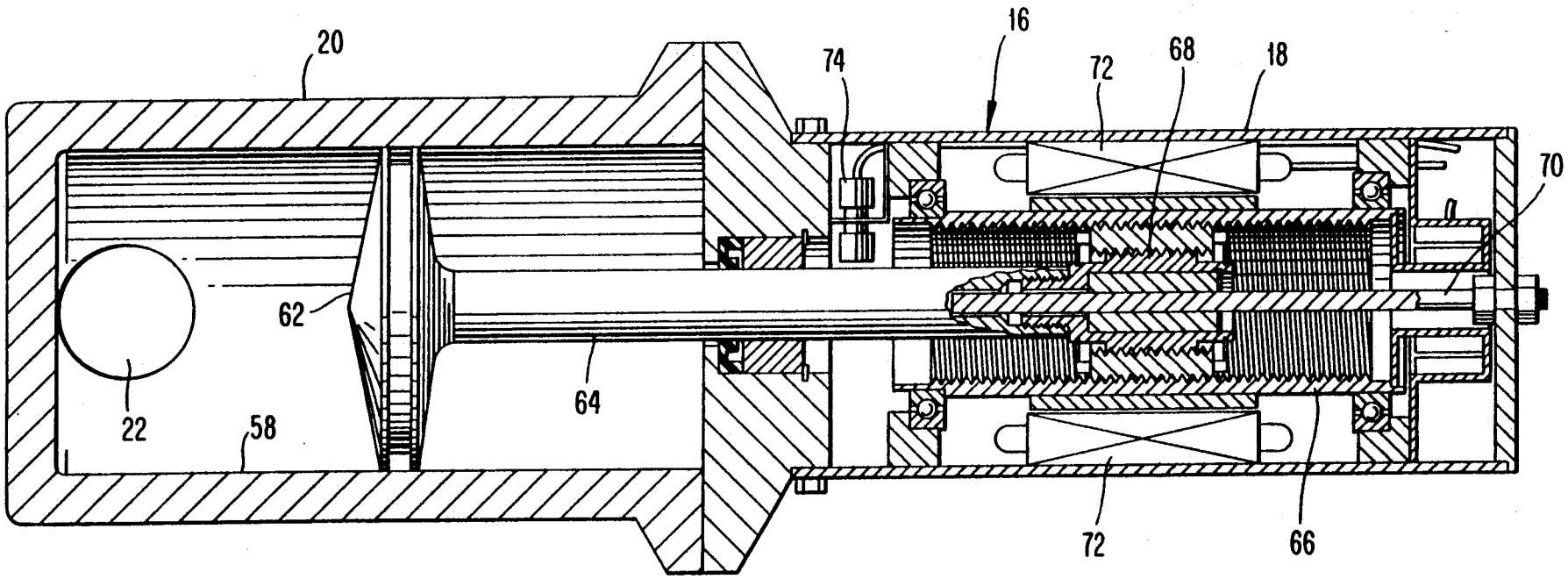
FIG. 5 is a cross-sectional view of the metering pump.

The metering pump assembly is shown in cross-section in FIG. 5 and includes an actuator 18 and a chamber body 20. The chamber body 20 has a central bore which forms a cylindrical metering chamber 58. A reciprocating piston 62 is mounted in the chamber 58. Force for displacing the piston 62 is transmitted to the piston 62 by a shaft 64.

Force is applied to displace the shaft 64 towards the right for drawing liquid product into the chamber 58 and towards the left for displacing liquid product out of the chamber by means of an electrically-driven rotary gear 66. The gear 66 has spiral grooves which operate with a reciprocating carriage which is prevented from rotating by the guide 70 which is fixed to the end plate of the actuator 18. The carriage 68 slides longitudinally along the guide 70, and since the shaft 64 is fixed to the carriage 68, longitudinal movement of the carriage causes corresponding movement of the shaft 64. The carriage is provided with a plurality of spiral rollers which transmit axial forces to the carriage in response to rotation of the gear 66. Rotation is imparted to the gear by motor coils 72 of a reversible motor. Suitable controls are provided for adjusting the rate of rotation of the gear 66 by the motor and for controlling the direction of rotation of the gear 66. A sensor 74 is positioned adjacent the shaft 64 to provide a signal corresponding to the position of the piston 62 in the chamber 58. For example, the position sensing means may include grooves or relief formed in the shaft 64 that could be sensed by the sensor 74, or other appropriate marking means could be provided. The sensor 74 cooperates with the control means for adjusting the displacement of the piston 62 to correspond to various sizes of cartons that are to be filled.

As shown in FIG. 1, the electro-pneumatic positioning mechanism 28 and the pneumatic cylinder 14 are connected to a control system 76 which controls the timing of the opening of the supply valve 12 and the dispensing valve 26. The control system 76 also controls the actuation of the pump actuator 18 for drawing liquid product into the chamber 58 and discharging the product from the chamber 58 into the dispensing valve 26. The control system 76 contains a timing system for controlling the duration and sequencing of the actuators 14, 28 and 18 to correspond to the size of the carton 2 and the rate of advance of the conveyor 4.

In operation, the tank 6 receives a supply of liquid product for filling cartons. The control system 76 causes the actuator 14 to displace the valve stem 45 downwardly to open the valve and, at the same time, the actuator 18 displaces the shaft 64 toward the right as viewed in FIG. 5 to draw liquid product into the chamber 58. During this period, the dispensing valve 26 is closed. When the piston 62 has been displaced sufficiently to draw in the predetermined quantity of liquid product into the chamber 58, the supply valve 12 is closed by the actuator 14 and the dispensing valve 26 is opened at the same time that the actuator 18 displaces the piston 62 toward the left as viewed in FIG. 5 to cause the liquid product to flow out of the dispensing valve 26 and into the carton. The rate of flow through the dispensing valve is controlled by the rate of displacement of the piston 62, which in turn is controlled by the rate of rotation of the gear 66 in response to excitation of the motor coils 72. In this manner, the operation of the fill system can be adjusted electrically to provide optimum filling conditions of the system. During cleaning of the system, cleaning solution is deposited in the tank 6 and the system is operated in the same manner as during product filling operation. The use of ball bearing guides for the valves 12 and 26 permits efficient cleaning of the valve guides, since the bearing components are fully exposed to the cleaning solution.

While this invention has been illustrated and described in accordance with a preferred embodiment, it is recognized that variations and changes may be made therein without departing from the invention as set forth in the claims.

What is claimed is:

1. Apparatus for dispensing liquid products comprising:

a source of liquid product;

dispensing valve means for selectively dispensing a quantity of liquid product;

liquid conduit means for conducting liquid product from said source to said dispensing valve means; said conduit means including metering chamber means for displacing a predetermined quantity of liquid product and including supply valve means for controlling flow of liquid product from said source into said metering chamber; said supply valve means including a valve element and a valve stem connected to said valve element for displacing said valve element relative to a valve seat;

bearing means for said valve stem, said bearing means being positioned in said conduit means and including a plurality of balls engaging said valve stem.

2. The apparatus according to claim 1 wherein said supply valve means includes a valve body having an inlet portion and an outlet portion, said valve seat forming said outlet portion.

3. The apparatus according to claim 2 wherein said valve body has a central passage, said valve stem being aligned with said central passage and said bearing means being located in said central passage.

4. The apparatus according to claim 3 wherein said valve stem has a plurality of recesses for retaining said balls during reciprocating motion of said valve stem.

5. The apparatus according to claim 4 wherein said bearing means includes a first set and a second set of balls, each of said sets including at least three balls, and said first and second sets being spaced longitudinally on said valve stem.

6. An apparatus for dispensing liquid food products of the type having a control valve for controlling the flow of said product, said control valve having a valve body which has an inlet opening and an outlet opening and an internal passage between the inlet and outlet opening, said control valve including a valve element for closing said outlet opening upon engagement with a valve seat and a valve stem connected with the valve element for displacing the valve element relative to the valve seat, the improvement wherein said valve stem is guided within said internal passage by bearing means, said bearing means including a plurality of balls in said internal passage engaging said valve stem.

7. The apparatus according to claim 6 wherein said valve stem is mounted for axial movement in said internal passage, and said plurality of balls are spaced apart longitudinally of said valve stem.

8. The apparatus according to claim 6 wherein said valve stem includes a plurality of recesses for retaining said balls.

9. The apparatus according to claim 7 wherein said bearing means includes a plurality of recesses spaced longitudinally of said valve stem for retaining said balls.

10. The apparatus according to claim 9 wherein at least three balls are spaced around said valve stem at each of said spaced locations.

* * * * *